US005827444A

United States Patent [19]

Shimizu et al.

[11] Patent Number: 5,827,444

[45] Date of Patent: Oct. 27, 1998

[54] STABILIZED MAGNETIC FLUID AND METHOD FOR STABILIZING MAGNETIC FLUID

[75] Inventors: Kazuya Shimizu, Yokohama; Kousuke Okura, Hiratsuka; Yusuke Matsumura, Chigasaki, all of Japan

[73] Assignee: Taiho Industries Co., Ltd., Tokyo, Japan

[21] Appl. No.: 638,155

[22] Filed: Apr. 26, 1996

[30] Foreign Application Priority Data

Mar. 1, 1996 [JP] Japan ..... 8-044357

[51] Int. Cl.[6] ..... H01F 1/44

[52] U.S. Cl. ..... 232/62.52; 252/62.53; 252/62.54

[58] Field of Search ..... 252/62.52, 62.54, 252/62.53

[56] References Cited

U.S. PATENT DOCUMENTS 4,025,448 5/1977 Sudol ..... 252/62.52
4,701,276 10/1987 Wyman ..... 252/62.52
4,976,883 12/1990 Kanno et al. ..... 252/62.52
5,143,637 9/1992 Yokouchi et al. ..... 252/62.52

*Primary Examiner*—Melissa Bonner
*Attorney, Agent, or Firm*—Browdy and Neimark

[57] ABSTRACT

The present invention provides a magnetic fluid which comprises a magnetic fluid comprising magnetic fine particles coated with a fatty acid in an oily medium, and at least one selected from the group consisting of sulfonate surfactants and animal waxes, has an excellent stability even when used at a high temperature and high humidity and having the fluidity maintained for a long period, and is suitable for use particularly in a severe environment as a bearing, magnetic damper, magnetic seal, specific gravity separator, liquid damper, switch, acceleration sensor, tilt sensor, or heat exchanger for heat pipe or heat sink, and further a magnetic fluid-stabilizing additive allowing the magnetic fluid to have an excellent stability for a long period while maintaining the magnetic fluid's own performance even when used at a high temperature and high humidity for a long period, and a method of stabilizing the magnetic fluid.

17 Claims, No Drawings

STABILIZED MAGNETIC FLUID AND METHOD FOR STABILIZING MAGNETIC FLUID

BACKGROUND OF THE INVENTION

1. Field of the Invention

The present invention relates to a magnetic fluid, a magnetic fluid-stabilizing additive and a method of stabilizing the magnetic fluid, and more particularly to a magnetic fluid having a good stability and a good fluidity even when maintained at a high temperature and high humidity for a long period, a magnetic fluid-stabilizing additive allowing the magnetic fluid to have a good stability and good fluidity when maintained at a high temperature and high humidity for a long period, and a method of providing the magnetic fluid with a good stability and good fluidity when maintained at a high temperature and high humidity for a long period.

2. Description of Related Art

Hitherto, there have been known magnetic fluids comprising magnetic fine particles of Fe ferrite, Mn—Zn ferrite, Ni—Zn ferrite. etc. having a higher fatty acid adsorbed thereon and dispersed in an oily solvent. For example, see JP-A-53-17118 disclosing one of these fluids.

However, these prior art magnetic fluids have a problem in that a magnetic fluid comprising magnetic fine particles of, for example, Fe ferrite obtained by coprecipitation and dispersed in an oily medium with use of an unsaturated fatty acid as a surfactant includes a minor amount of salts or moisture retained therein or a minor amount of water from the outside, so that the magnetic fluid may become gradually deteriorated due to the gelling thereof when used for a long period.

Such gelling causes the magnetic fluid to be more reactive and corrosive as temperature and humidity increase. Therefore, in prior art magnetic fluids, serious problems have occurred particularly at a high temperature and a high humidity. These problems are that the prior art magnetic fluids are easily deteriorated at a high temperature and a high humidity, and hence must be often replaced with a new one; and, furthermore, they do hardly exhibit their inherent performance, which problems induce a lower productivity.

Recently, a variety of technological or commercial fields have demanded development of magnetic fluids which are kept highly stable and fluid in an atmosphere of high temperatures and high humidities for a long period.

The present invention has been made to satisfy such demand.

SUMMARY OF THE INVENTION

The object of the present invention is to provide a magnetic fluid which is highly stable and can well exhibit its inherent performance as magnetic fluid for a long period when used in an atmosphere of high temperatures and high humidities.

Another object of the present invention is to provide a magnetic fluid which hardly deteriorates at all and has a good fluidity maintained for a long period.

A further object of the present invention is to provide a magnetic fluid-stabilizing additive allowing a magnetic fluid to have a good stability and exhibit its inherent performance as magnetic fluid for a long period when used in an atmosphere of high temperatures and high humidities.

A still further object of the present invention is to provide a method of providing a magnetic fluid with a good stability and a good fluidity maintained at a high temperature and high humidity for a long period.

In accordance with the present invention, at least one additive selected from the group consisting of sulfonate surfactants and animal waxes is added to prior art oily magnetic fluids to improve the stability of magnetic fluid at a high temperature and high humidity to a large extent. Thus, the present inventors have found that stabilized magnetic fluids can well exhibit its performance such as fluidity in an atmosphere of high temperatures and high humidities for a long period by adding thereto at least one selected from the group consisting of sulfonate surfactants and animal waxes.

In accordance with an embodiment of the present invention, a stabilized magnetic fluid is provided which comprises magnetic particles coated with a fatty acid and dispersed in an oily medium and at least one selected from the group consisting of sulfonate surfactants and animal waxes.

In accordance with another embodiment of the present invention, a magnetic fluid-stabilizing additive is provided which comprises at least one selected from the group consisting of sulfonate surfactants and animal waxes.

In accordance with a further embodiment of the present invention, the additive further contains a dispersant.

In accordance with a still further embodiment of the present invention, a method of stabilizing a magnetic fluid by mixing magnetic particles coated with a fatty acid and dispersed in an oily medium with at least one selected from the group consisting of sulfonate surfactants and animal waxes.

The present invention will be in detail explained below.

DESCRIPTION OF PREFERRED EMBODIMENTS

Magnetic Fluid

As the magnetic fluid comprising a dispersion of magnetic particles coated with a fatty acid in an oily medium may be used a well-known oily magnetic fluid.

The magnetic particles used may be made of Fe ferrite, Mn—Zn ferrite, Mg—Zn ferrite, Ni—Zn ferrite, etc.

These particles are preferably of 30–500 Å in particle size. The amount of magnetic particles in the stabilized magnetic fluid may vary depending upon uses, and preferably ranges from 3 to 70% by weight.

The fatty acid with which the magnetic particles may normally have a carbon number of 10–30, preferably 12–28. For example, it may be a higher aliphatic carboxylic acid such as oleic acid, stearic acid, palmitic acid, lauric acid, linoleic acid, linoleinic acid, erucic acid, myristic acid or behenic acid.

For coating the particles with the fatty acid, there may be used a well-known method. For example, the coating may be carried out by bringing the magnetic fine particles into contact with a fatty acid salt such as a sodium salt, a potassium salt or an ammonium salt of the above-mentioned fatty acid. Such a method is described in, for example, JP-A-53-4078.

Particularly are preferred sodium oleate, potassium oleate, ammonium oleate, sodium stearate, sodium palmitate, potassium laurate, sodium erucate, sodium myristate, potassium myristate, sodium behenate, etc.

The amount of the fatty acid adsorbed on the magnetic fine particles varies depending upon a particle size of the magnetic fine particles, but it is normally in the range of 5–45 wt %, preferably 10–40 wt % based on the weight of the particles.

When the amount of the fatty acid adsorbed is within the above-mentioned range, the stability of magnetic fluid can be particularly improved by adding at least one additive selected from the group consisting of sulfonate surfactants and animal waxes.

As the oily medium for dispersing the magnetic fine particles coated with a fatty acid, reference may be made to an aliphatic hydrocarbon such as n-heptane, n-hexane, n-octane, isooctane, n-decane, 1-decene, cyclohexane, cyclooctane and methylcyclooctane; an aromatic hydrocarbon such as benzene, toluene, xylene, mesytilene, ethylbenzene and tetralin; an ether such as diethyl ether, di-n-propyl ether, di-isopropyl ether, di-n-butyl ether, tetrahydrofuran and dioxane; a paraffin or isoparaffin petroleum solvent such as kerosene and gas oil; and a medium having a low vapor pressure, such as an alkyl naphthalene, a poly-α-olefin hydride, an alkylphenyl ether and an ester.

The stabilized magnetic fluid of the present invention comprises a magnetic fluid comprising the above-mentioned magnetic fine particles dispersed in one or more of the above-mentioned medium, and at least one additive selected from the group consisting of sulfonate surfactants and animal waxes.

The magnetic fluid-stabilizing additive comprises at least one additive selected from the group consisting of sulfonate surfactants and animal waxes and, if desired, a dispersant.

Sulfonate Surfactants

The sulfonate surfactants include at least one of the sulfonates represented by the following general formula of $$(RSO_3)_nMe$$

wherein Me is a metal atom having a valence number of n, and R is a hydrocarbyl group containing 10–80 carbon atoms, and may be any of an aromatic sulfonate and chain sulfonate.

As the metal atom Me in the general formula reference may be made to an alkali metal or an alkaline earth metal such as sodium, potassium, calcium and barium. As the hydrocarbyl group R containing 10–80 carbon atoms reference may be made to an aliphatic hydrocarbyl group such as hexyl group, octyl group, nonyl group, decyl group, dodecyl group, tetradecyl group, hexadecyl group, octadecyl group and icosyl group; and an aromatic hydrocarbyl group such as an alkylaryl group (e.g., an alkylphenyl group), benzyl group and naphthyl group.

The sulfonate surfactant used in the present invention is preferably an alkylaryl sulfonate containing not less than 10 carbon atoms, particularly preferably containing 20–40 carbon atoms.

These sulfonate surfactants may be used singly or in combination of two or more thereof.

Animal Waxes

As the animal waxes may be used beeswax, lanolin, spermaceti, etc. Lanolin is particularly preferred.

These animal waxes may be used singly or in combination of two or more thereof.

The above-mentioned lanolin may be a material recovered from a secretion such as fats of sheep adhered to wool and then purified, such as cholesterol, lanosterol, agnosterol, an ester such as lanoceric acid, lanopalmitic acid and linoceric acid, free cholesterin, cetyl alcohol, ceryl alcohol, carnaubic alcohol, etc.

The lanolins used in the present invention all need not be used, but at least one of cholesterin, lanosterin, agnosterin, lanoceric acid, lanopalmitic acid and lignoceric acid should be used.

The amount of the sulfonate surfactants and/or animal waxes added is normally not more than 30 parts by weight, preferably not less than 0.5 part by weight, particularly preferably in the range of 1–10 parts by weight, based on 100 parts by weight of the magnetic fluid.

When the amount is within the above-mentioned range, the stabilized magnetic fluid having a good stability at a high temperature and a high humidity can be obtained.

If the sulfonate surfactant is used singly, the amount thereof is preferably not more than 20 parts by weight, particularly preferably 1–10 parts by weight based on 100 parts by weight of the magnetic fluid. On the other hand, when the animal wax is used singly, the amount thereof is preferably not more than 5 parts by weight, particularly preferably 0.5–2 parts by weight of the magnetic fluid.

Dispersant

The magnetic fluid-stabilizing additive may preferably contain a dispersant, if desired. The dispersant may preferably be an oxyalkylene group-containing phosphate, or a mixture thereof, represented by the general formula of

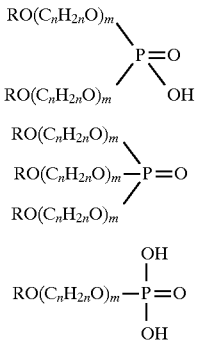

wherein R is an alkyl group containing 6–24 carbon atoms or an alkylphenyl group containing 5–10 carbon atoms, n is 2 or 3, and m is an integer of 2–20.

As the phosphate, reference may be made to a polyoxyethylenemonoalkylether phosphate, polyoxyethylenedialkylether phosphate, polyoxyethylenetrialkylether phosphate, polyoxyethylenemonoalkylphenylether phosphate, polyoxyethylenedialkylphenylether phosphate, polyoxyethylenetrialkylphenyl phosphate, etc.

Incorporation of this dispersant further improves the humidity resistance of the stabilized magnetic fluid of the present invention.

The amount of the dispersant added to the magnetic fluid is normally 0.1–10 parts by weight, preferably 0.5–5 parts by weight, based on 100 parts by weight of the magnetic fluid.

The amount of each of the components constituting the magnetic fluid-stabilizing additive is as mentioned above. On the other hand, the relation between the amount of the additive added and the stabilizing effect depends upon the kind and content of the magnetic particles constituting the magnetic fluid and the kind of the oily medium and compatibility thereof with the additive. The kind and content of the magnetic particles and the kind of the oily medium are mainly selected depending on uses. When this additive is so added to the magnetic fluid that the amount of the additive is the same as that of the magnetic fluid, the stabilizing effect generally becomes greater as the content of the magnetic particles is smaller. In general, there is such a tendency that the effect is improved to a larger extent as the added amount is increasing. The limit of the added amount is 10–15 parts by weight based on 100 parts by weight. There is no change in the effect of stability even when the amount exceeds the limit, but rather there may be precipitation of the components of the additive to separate solids.

Method of Stabilizing Magnetic Fluid

In accordance with the method of the present invention, the magnetic particles as mentioned above are coated with a fatty acid and dispersed in an oily medium to form a magnetic fluid, to which at least one selected from the group consisting of sulfonate surfactants and animal waxes, and optionally a dispersant are admixed.

For mixing the magnetic fluid with the magnetic fluid-stabilizing additive, various methods may be used, and these methods are unlimited as far as they can achieve a sufficient mixing. For mixing, various known blenders or mixers, homogenizers, ball mills and ultrasonic apparatuses may be used.

The mixing can be carried out at a normal or an elevated temperature, which is preferably not higher than 100° C. When the mixing is carried out in this temperature range, the viscosity is advantageously lowered, so that the mixing becomes easy and the magnetic fluid is shortly homogenized.

For incorporating the animal waxes such as lanolin, they may be previously diluted in a base oil. The base oil is unlimited and should be able to dissolve or disperse the animal waxes therein. As the base oil may be used the various oily mediums referred to above as a dispersant for the magnetic particles.

Since the magnetic fluid composition thus prepared has a very good stability and particularly is highly dispersed at a high temperature and a high humidity for a long period, it can conveniently be used for various purposes.

Thus, the stabilized magnetic fluid of the present invention can be used in, for example, a pressure sealing, a rotary axis sealing, bearing, or as a specific gravity separator, a liquid damper, a switch, an acceleration sensor, a tilt sensor, or a heat exchanger for heat pipes or heat sinks.

The present invention will be illustrated below with reference to some examples.

EXAMPLES 1–16

Oily magnetic fluids A to D were prepared in such a manner as mentioned below.

Oily Magnetic Fluid A

A mixture comprising 100 ml of an aqueous 0.5 mol/l ferrous sulfate solution and 100 ml of an aqueous 0.5 mol/l ferric sulfate solution was mixed with 220 ml of a 2 mol/l sodium hydroxide solution to prepare 11.6 g of Fe ferrite particles, to which was then added 70 g of an aqueous 5 wt % sodium oleate solution to prepare 14.8 g of Fe ferrite particles coated with the oleic acid. Then, the oleic acid-coated magnetic particles were dispersed in a poly-α-olefin hydride (under a tradename of "Lipoloop 60", produced by Lion Corporation) to prepare oily magnetic fluid A.

Oily Magnetic Fluid B

A mixture of 120 ml of an aqueous 0.5 mol/l iron (II) chloride solution and 180 ml of an aqueous 0.5 mol/l iron (III) chloride solution was adjusted to a pH of 8 by adding thereto an aqueous 28% ammonia to prepare 11.6 g of Fe ferrite. To 11.6 g of the resulting Fe ferrite particles were added 56 g of an aqueous 5 wt % sodium oleate solution and 14 g of an aqueous 5 wt % sodium palmitate solution, to prepare 14.8 g of the Fe ferrite particles coated with oleic acid and palmitic acid. Then, the thus obtained oleic acid and palmitic acid-coated Fe ferrite particles were dispersed in a paraffin (tradename: Stanol 40, produced by Esso Petroleum, Inc.) to prepare oily magnetic fluid B.

Oily Magnetic Fluid C

To a mixture of 50 ml of an aqueous 0.5 mol/l manganese (II) chloride solution, 50 ml of an aqueous 0.5 mol/l zinc chloride solution and 200 ml of an aqueous 0.5 mol/l iron (III) chloride solution was admixed 300 ml of an aqueous 2 mol/l sodium hydroxide, to prepare 11.8 g of Mn—Zn ferrite particles. To 11.8 g of the Mn—Zn ferrite particles was added 72 g of an aqueous 5 wt % sodium oleate solution, to prepare 15.4 g of the oleic acid-coated Mn—Zn ferrite particles, which were then dispersed into an alkyldiphenylether LB68 (tradename: Molescohiloop, produced by Matsumura Petroleum Laboratory, Ltd.) to prepare oily magnetic fluid C.

Oily Magnetic Fluid D

To a mixture of 50 ml of an aqueous 0.5 mol/l magnesium chloride, 50 ml of an aqueous 0.5 mol/l zinc chloride solution and 200 ml of an aqueous 0.5 mol/l iron (III) chloride solution was admixed 300 ml/l of an aqueous 2 mol/l sodium hydrochloride solution to prepare 11.0 g of Mg—Zn ferrite particles. To 11.0 g of the Mg—Zn ferrite particles were added 68 g of an aqueous 5 wt % sodium palmitate to prepare 14.4 g of palmitic acid-coated Mg—Zn ferrite particles, which were then dispersed into a mixed medium of a paraffin (tradename: Stanol 40, produced by Esso Petroleum, Inc.) and an ester (tradename: DIDA, produced by Daihachi Chemical Industries, Ltd.) in a ratio of 9:1, to prepare oily magnetic fluid D.

To each of the resulting oily magnetic fluids A to D was added the ingredients as mentioned below, and the admixture was adequately mixed at 60° C. to produce the magnetic fluid. The compositions of the oily magnetic fluids and the additives are shown in Table 1.

The resulting magnetic fluids were examined for the stability of heat resistance and stability of humidity resistance, by conducting the promotion tests as mentioned below. The results are shown in Table 1.

Stability of Heat Resistance

Each of the resulting magnetic fluids was placed in a Petri dish, which was kept in a blowing drier at 140° C. The gelling process was observed for each of the magnetic fluids. The heat resistance of the magnetic fluids was evaluated with the fluidity thereof after 80 hours, 100 hours, 150 hours, 200 hours and 250 hours from the beginning.

In Table 1, "AA" means that the fluidity was maintained after 250 hours elapsed, "A" means that the fluidity was maintained when 200 hours elapsed, "BB" means that the fluidity was lost when 150 hours elapsed, "B" means that the gelling occurred when 100 hours elapsed, and "C" means that the gelling occurred before 80 hours elapsed.

Stability of Humidity Resistance

Each of the resulting magnetic fluids was placed in a Petri dish, which was kept in a thermo-hygrostat at 80°0C. and 85% in humidity. The humidity resistance of the magnetic fluids was evaluated with the condition thereof after 50 hours, 70 hours, 120 hours and 170 hours from the beginning.

In Table 1, "XX" means that the fluidity was maintained after 220 hours elapsed, "X" means that the fluidity was maintained when 170 hours elapsed, "YY" means that the gelling occurred when 120 hours elapsed, "Y" means that the gelling occurred when 70 hours elapsed, and "Z" means that the gelling occurred before 50 hours.

| <Compositions of Stabilized Magnetic Fluids> | |
|---|---|
| Example 1: | |
| Oily magnetic fluid A (40 wt % particles) | 100 parts by weight |
| Barium alkylaryl sulfonate (tradename: Sulfor Ba-30N, made by Matsumura Petroleum Laboratory, Ltd.) | 3 parts by weight |
| Example 2: | |
| Oily magnetic fluid A (15 wt % particles) | 100 parts by weight |
| Barium alkylaryl sulfonate (tradename: Sulfor Ba-30N, made by Matsumura Petroleum Labortory, Ltd.) | 3 parts by weight |
| Example 3: | |
| Oily magnetic fluid B (35 wt % particles) | 100 parts by weight |
| Barium alkylaryl sulfonate (tradename: Sulfor Ba-30N, made by Matsumura Petroleum Laboratory, Ltd.) | 6 parts by weight |
| Example 4: | |
| Oily magnetic fluid D (25 wt % particles) | 100 parts by weight |
| Barium alkylaryl sulfonate (tradename: Sulfor Ba-30N, made by Matsumura Petroleum Laboratory, Ltd.) | 9 parts by weight |
| Example 5: | |
| Oily magnetic fluid C (30 wt % particles) | 100 parts by weight |
| Calcium alkylaryl sulfonate (tradename: Briton C-45, made by Briton Chemical Inc.) | 3 parts by weight |
| Example 6: | |
| Oily magnetic fluid D (25 wt % particles) | 100 parts by weight |
| Purified lanolin (made by Croda, Japan, Ltd.) | 0.5 part by weight |
| Example 7: | |
| Oily magnetic fluid A (40 wt % particles) | 100 parts by weight |
| Purified lanolin (made by Croda, Japan, Ltd.) | 1 part by weight |
| Example 8: | |
| Oily magnetic fluid B (35 wt % particles) | 100 parts by weight |
| Calcium alkylaryl sulfonate (tradename: Briton C-45, made by Briton Chemical Inc.) | 3 parts by weight |
| Purified beewax (made by Noda Wax, Ltd.) | 0.5 part by weight |
| Example 9: | |
| Oily magnetic fluid B (5 wt % particles) | 100 parts by weight |
| Calcium alkylaryl sulfonate (tradename: Briton C-45, made by Briton Chemical Inc.) | 3 parts by weight |
| Purified beewax (made by Noda Wax, Ltd.) | 0.5 part by weight |
| Example 10: | |
| Oily magnetic fluid C (30 wt % particles) | 100 parts by weight |
| Calcium alkylaryl sulfonate (tradename: Briton C-45, made by Briton Chemical Inc.) | 3 parts by weight |
| Polyoxyethylenetrialkylphenylether phosphate (tradename: NIKKOL TDP-2, made by Nikko Chemicals, Ltd.) | 1 part by weight |

-continued

| <Compositions of Stabilized Magnetic Fluids> | |
|---|---|
| Example 11: | |
| Oily magnetic fluid D (25 wt % particles) | 100 parts by weight |
| Calcium alkylaryl sulfonate (tradename: Briton C-45, made by Briton Chemical Inc.) | 3 parts by weight |
| Polyoxyethylenetrialkylphenylether phosphate (tradename: NIKKOL TDP-2, made by Nikko Chemicals, Ltd.) | 2 parts by weight |
| Example 12: | |
| Oily magnetic fluid A (40 wt % particles) | 100 parts by weight |
| Calcium alkylaryl sulfonate (tradename: Briton C-45, made by Briton Chemical Inc.) | 2 parts by weight |
| Purified beeswax (made by Noda Wax, Ltd.) | 0.5 part by weight |
| Polyoxyethylenedialkylphenylether phosphate (tradename: Phosphanol RM-410, made by Toho Chemical Industries, Ltd.) | 1 part by weight |
| Example 13: | |
| Oily magnetic fluid D (40 wt % particles) | 100 parts by weight |
| Calcium alkylaryl sulfonate (tradename: Briton C-45, made by Briton Chemical Inc.) | 6 parts by weight |
| Purified beeswax (made by Noda Wax, Ltd.) | 1 part by weight |
| Polyoxyethylenedialkylphenylether phosphate (tradename: Phosphanol RM-410, made by Toho Chemical Industries, Ltd.) | 3 parts by weight |
| Example 14: | |
| Oily magnetic fluid B (35 wt % particles) | 100 parts by weight |
| Barium alkylaryl sulfonate (tradename: Sulfor Ba-20N, made by Matsumura Petroleum Laboratory, Ltd.) | 0.3 part by weight |
| Example 15: | |
| Oily magnetic fluid C (30 wt % particles) | 100 parts by weight |
| Calcium alkylaryl sulfonate (tradename: Briton C-45, made by Briton Chemical Inc.) | 0.3 part by weight |
| Purified beeswax (made by Noda Wax, Ltd.) | 0.2 part by weight |
| Example 16: | |
| Oily magnetic fluid D (25 wt % particles) | 100 parts by weight |
| Barium alkylaryl sulfonate (tradename: Sulfor Ba-20N, made by Matsumura Petroleum Laboratory, Ltd.) | 0.5 part by weight |
| Calcium alkylaryl sulfonate (tradename: Briton C-45, made by Briton Chemical Inc.) | 0.5 part by weight |
| Purified lanolin (made by Croda, Japan, Ltd.) | 0.2 part by weight |
| Polyoxyethylenedialkylphenyether phosphate (tradename: Phosphanol RM-410, made by Toho Chemical Industries, Ltd.) | 0.3 part by weight |

COMPARATIVE EXAMPLES 1 to 6

Oily magnetic fluid A (40 wt % particles), oily magnetic fluid A (15 wt % particles), oily magnetic fluid B (35 wt % particles), oily magnetic fluid B (5 wt % particles), oily magnetic fluid C (25 wt % particles) and oily magnetic fluid D (25 wt % particles) each was examined for the stability of heat resistance and stability of humidity resistance in the same manner as in the Examples. The results are shown in Table 1.

TABLE 1

| | | Example | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Oily magnetic fluid | A | 100 | 100 | | | | | 100 | | | | |
| | B | | | 100 | | | | | 100 | 100 | | |
| | C | | | | | 100 | | | | | 100 | |
| | D | | | | 100 | | 100 | | | | | 100 |
| Surfactant | Barium alkylaryl sulfonate | 3 | 3 | 6 | 9 | | | | | | | |
| | Calcium alkylaryl Sulfonate | | | | | 3 | | | 3 | 3 | 3 | 3 |
| Waxes | Lanolin | | | | | | 0.5 | 1 | | | | |
| | Beewax | | | | | | | | 0.5 | 0.5 | | |
| Dispersant | POE trialkylether hosphate | | | | | | | | | | 1 | 2 |
| | POE dialkylphenyl ether phosphate | | | | | | | | | | | |
| Content of magnetic particles (wt %) | | 40 | 15 | 35 | 25 | 30 | 25 | 40 | 35 | 5 | 30 | 25 |
| Heat resistance | | A | AA | AA | AA | A | BB | BB | A | AA | A | AA |
| Humidity resistance | | YY | X | XX | XX | YY | YY | X | X | XX | X | X |

| | | Example | | | | | Comparative example | | | | | |
|---|---|---|---|---|---|---|---|---|---|---|---|---|
| | | 12 | 13 | 14 | 15 | 16 | 1 | 2 | 3 | 4 | 5 | 6 |
| Oily magnetic fluid | A | 100 | | | | | 100 | 100 | | | | |
| | B | | | 100 | | | | | 100 | 100 | | |
| | C | | | | 100 | | | | | | 100 | |
| | D | | 100 | | | 100 | | | | | | 100 |
| Surfactant | Barium alkylaryl sulfonate | | | 0.3 | | 0.5 | | | | | | |
| | Calcium alkylaryl Sulfonate | 2 | 6 | | 0.3 | 0.5 | | | | | | |
| Waxes | Lanolin | | | | | 0.2 | | | | | | |
| | Beewax | 0.5 | 1 | | 0.2 | | | | | | | |
| Dispersant | POE trialkylether hosphate | | | | | | | | | | | |
| | POE dialkylphenyl ether phosphate | 1 | 3 | | | 0.3 | | | | | | |
| Content of magnetic particles (wt %) | | 40 | 25 | 35 | 30 | 25 | 40 | 15 | 35 | 5 | 30 | 25 |
| Heat resistance | | A | AA | BB | BB | BB | C | C | C | B | B | C |
| Humidity resistance | | X | XX | YY | YY | X | Z | Y | Y | Y | Z | Z |

According to the present invention, it is possible to provide a magnetic fluid having an excellent stability and capable of adequately exhibiting the magnetic fluid's own performance at a high temperature and a high humidity.

According to the present invention, it is possible to provide a magnetic fluid which is very hardly deteriorated even when used at a high temperature and a high humidity, and has the fluidity which can be maintained for a long period.

According to the present invention, it is possible to provide a magnetic fluid-stabilizing additive allowing the magnetic fluid to have an excellent stability for a long period while maintaining the magnetic fluid's own performance even when used at a high temperature and a high humidity for a long period.

According to the present invention, it is possible to provide a method of allowing the magnetic fluid to have an excellent stability which can be maintained at a high temperature and a high humidity for a long period.

What is claimed is:

1. A stabilized magnetic fluid which comprises:

magnetic fine particles coated with a fatty acid and dispersed in a poly-α-olefin hydride, a sulfonate surfactant, and a dispersant of the formula

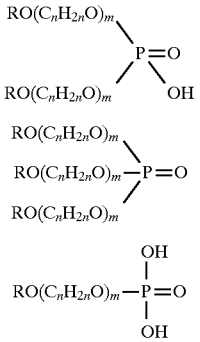

wherein R is an alkyl group containing 6–24 carbon atoms or an alkylphenyl group containing 5 to 10 carbon atoms, n is 2 or 3, and m is an integer of 2 to 20.

2. A stabilized magnetic fluid according to claim 1, wherein said magnetic fine particles are of 30–500 Å in particle size.

3. A stabilized magnetic fluid according to claim 1, wherein said magnetic fine particles are primarily composed of Fe ferrite.

4. A stabilized magnetic fluid according to claim 1, wherein said fatty acid is a straight-chain aliphatic carboxylic acid containing 10–30 carbon atoms.

5. A stabilized magnetic fluid according to claim 1, wherein said fatty acid is a straight-chain aliphatic carboxylic acid containing 12–28 carbon atoms.

6. A stabilized magnetic fluid according to claim 1, wherein said sulfonate surfactant is an alkylaryl sulfonate.

7. A stabilized magnetic fluid according to claim 1, wherein the total amount of said sulfonate surfactants added is 30 wt % or less based on the weight of said magnetic fluid.

8. A stabilized magnetic fluid which comprises:

a magnetic fluid formed of magnetic fine particles coated with 5–45 weight %, based on the weight of the particles, of a fatty acid, and dispersed in an oily medium, a sulfonate surfactant of the formula $(RSO_3)_xMe$, wherein Me is a metal atom having a valance number of x, and R is hydrocarbyl group containing 10–80 carbon atoms, optionally an animal wax, the total amount of sulfonate surfactant and animal wax being within the range of 0.5 to 30 parts by weight based on 100 parts by weight of said magnetic fluid, and 0.1–10 parts by weight per 100 parts by weight of said magnetic fluid of a dispersant of the formula

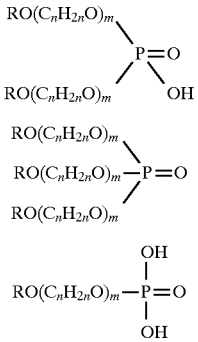

wherein R is an alkyl group containing 6–24 carbon atoms or an alkylphenyl group containing 5 to 10 carbon atoms, n is 2 or 3, and m is an integer of 2 to 20.

9. A stabilized magnetic fluid according to claim 8 wherein said sulfonate surfactant is present in an amount of not more than 20 parts by weight per 100 parts by weight of said magnetic fluid.

10. A stabilized magnetic fluid according to claim 8 wherein said dispersant is present in an amount of 0.5–5 parts by weight per 100 parts of said magnetic fluid.

11. A magnetic fluid according to claim 8, wherein said animal wax is lanolin or beeswax.

12. A stabilized magnetic fluid which comprises:

magnetic fine particles coated with a fatty acid and dispersed in an oily medium, a sulfonate surfactant containing at least one sulfonate represented by the formula $RSO_3)_nMe$ wherein Me is a metal atom having a valence number of n, and R is a hydrocarbyl group containing 10–80 carbon atoms, and a dispersant of the formula

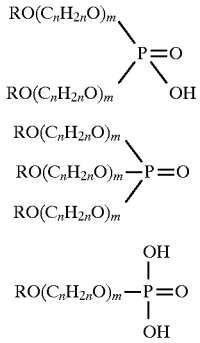

wherein R is an alkyl group containing 6–24 carbon atoms or an alkylphenyl group containing 5 to 10 carbon atoms, n is 2 or 3, and m is an integer of 2 to 20.

13. A stabilized magnetic fluid according to claim 12, wherein Me is an alkali metal atom or an alkaline earth metal atom.

14. A stabilized magnetic fluid according to claim 12, wherein said magnetic fine particles are of 30–500 Å in particle size.

15. A stabilized magnetic fluid according to claim 12, wherein said magnetic fine particles are primarily composed of Fe ferrite.

16. A stabilized magnetic fluid according to claim 12, wherein said fatty acid is a straight-chain aliphatic carboxylic acid containing 12–28 carbon atoms.

17. A stabilized magnetic fluid according to claim 12, wherein the total amount of said sulfonate surfactants added is 30 wt % or less based on the weight of the magnetic fluid.

* * * * *